United States Patent [19]

Zebuhr

[11] 4,133,055

[45] Jan. 9, 1979

[54] PROTECTIVE HELMET WITH THERMAL LINER

[75] Inventor: William H. Zebuhr, Nashua, N.H.

[73] Assignee: Energy Systems Corporation, Nashua, N.H.

[21] Appl. No.: 821,506

[22] Filed: Aug. 3, 1977

[51] Int. Cl.[2] ..... A42B 3/00; A42B 1/00

[52] U.S. Cl. ..... 2/411; 2/8; 150/2.3

[58] Field of Search ..... 2/7, 410, 411, 412, 2/413, 420; 150/2.3

[56] References Cited

U.S. PATENT DOCUMENTS

| | | | |
|---|---|---|---|
| 724,444 | 4/1903 | Curtiss | 2/413 |
| 2,320,467 | 6/1943 | Rabil | 2/7 UX |
| 2,335,630 | 11/1943 | Bacharoly | 2/7 |
| 2,602,302 | 7/1952 | Poux | 2/7 X |
| 2,618,780 | 11/1952 | Cushman | 2/413 |
| 3,070,803 | 1/1963 | Slepicka | 2/7 |
| 3,344,433 | 10/1967 | Stapenhill | 2/420 |

*Primary Examiner*—Werner H. Schroeder
*Assistant Examiner*—Andrew M. Falik

[57] ABSTRACT

The invention provides a thermal liner for a protective helmet, a helmet which includes such a liner removably positioned therein, and a container for the freezing and storage of a plurality of such liners. The thermal liner includes a matrix of sufficient length and width which is sufficiently deformable so as to be insertable within a helmet in spaced relation to its inner wall to confrom generally with the contour of the inner wall and to be coextensive with the major portion of the inner wall area. The liner is provided with a plurality of pockets in the matrix each of which is sealed relative to the other pockets. A heat exchange medium, preferably in its frozen state such as ice, is disposed within the pockets of the liner.

7 Claims, 3 Drawing Figures

PROTECTIVE HELMET WITH THERMAL LINER

BACKGROUND OF THE INVENTION

The present invention relates to thermal liners for protective helmets, to helmets containing such liners, and to a container within which liners supplied with a coolant can be cooled to freeze the coolant and within which container the liners can be stored until withdrawn for use.

Protective helmets have been employed heretofore for many purposes. Such helmets are part of the standard equipment in many sports such as football, hockey and auto racing. Similar helmets are also frequently worn by construction workers to prevent injury from falling objects. Persons wearing protective helmets often engage in strenuous physical activity while wearing such protective device, and considerable body heat is generated consequent to this activity. On the other hand, the helmets are frequently worn in environments where relatively high temperatures prevail. Under either of the foregoing circumstances it has not been uncommon for the helmet wearing individuals to develope a condition known as hyperthermia which has led to fatalities. The invention is intended to prevent the development of such condition.

SUMMARY OF THE INVENTION

It is one object of this invention to provide a thermal liner for a protective helmet can be removably positioned within the helmet to control the body temperature of the individual wearing the helmet, particularly when the helmet is worn while such individual is engaging in strenuous physical activity and/or is subjected to an environment of relatively high temperature.

It is another object of this invention to provide a thermal liner for a protective helmet of the character referred to which can be deformed to conform generally to the inner contour of the helmet when in use.

It is still another object of the invention to provide a protective helmet which includes a removable thermal liner of the character described herein.

It is yet another object of the invention to provide a container within which a plurality of thermal liners of the character described herein can be cooled to a temperature at which the heat exchange medium contained therein is frozen and within which such liners can be stored for a substantial period of time in the frozen state until removed for use.

Other objects and advantages of the invention will become readily apparent to persons versed in the art from the following description of the invention.

BRIEF DESCRIPTION OF THE DRAWINGS

In order that the invention may be more fully comprehended it will now be described, by way of example, with reference to the accompanying drawings in which.

DETAILED DESCRIPTION OF THE INVENTION

Figure 1:
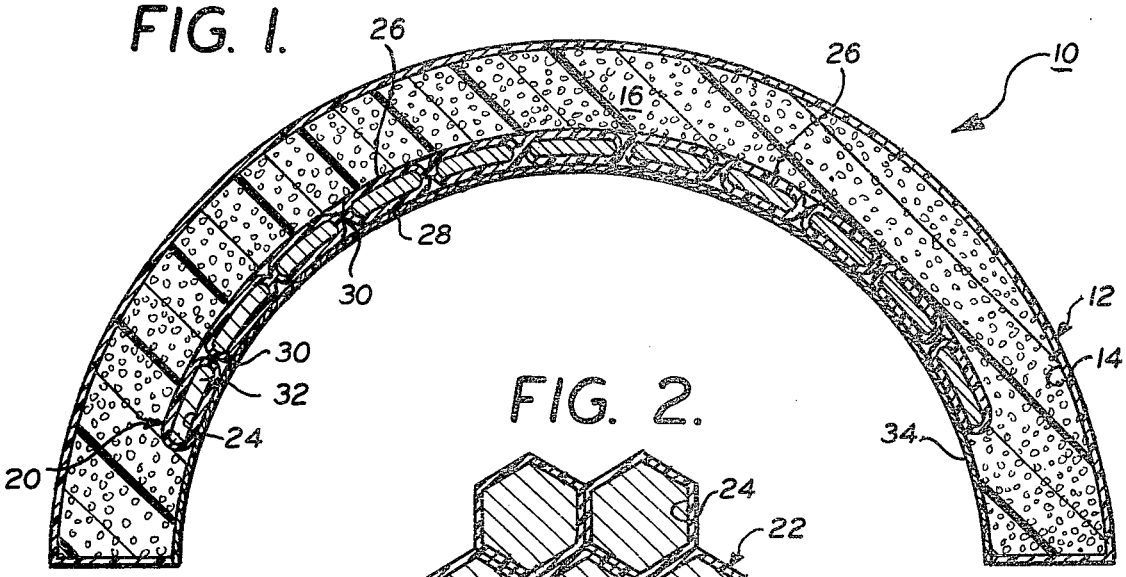
FIG. 1 is a fragmentary front view, in cross-section, of a protective helmet embodying the features of the invention.
Figure 2:
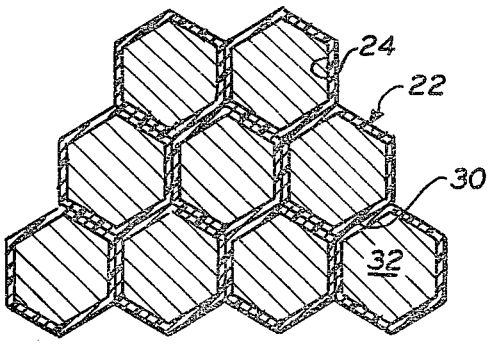
FIG. 2 is a fragmentary top plan view, in cross-section, of the thermal liner of the invention.

Referring to the drawings there is shown in FIG. 1 a portion of a helmet 10 comprising a shell 12 having an arcuate configuration, preferably in the general shape of a dome, and extending downwardly a sufficient distance to afford the desired protection for the head of the individual to be protected. The shell includes an inner wall 14 which usually follows the contour of the exterior of the shell but which, in any event, is contoured to facilitate positioning of the helmet upon the head of the individual. As is well known, the shell of the helmet may desirably be made of any of the commercially available high impact resistant polymeric materials. However, it is within the contemplation of the invention to fabricate the shell of a suitable metal, as are a number of the so-called "hard hats" worn by construction workers, or even of leather which has been reinforced to provide the desired rigidity.

An impact absorbing material 16 is positioned within the shell in face-to-face abutting contact with the inner wall thereof and extends over all or a substantial portion of such inner wall. The material 16 is desirably a foam material such, for example, as polystyrofoam and advantageously possesses thermal insulating properties which enables it to serve as a thermal insulator for the thermal liner 20 to be hereinafter described. Thus, the layer of impact absorbing material prevents, or at least inhibits to a significant extent, the influx or transmission of heat from the environment to the thermal liner. In conventional helmets it is the presence of such an impact absorbing layer which contributes substantially to an excessive build-up of heat within the helmet due to the radiation of heat from the head of the wearer.

A thermal liner 20 is positioned removably within the helmet inwardly of impact absorbing layer 16. Such liner comprises a generally planar disposed matrix 22 of sufficient length and width which is sufficiently deformable so as to permit its insertion within the shell of the helmet. As can be seen from FIG. 1, the liner is positioned within the shell so as to be insulated from the environment by impact absorbing layer 16 and to extend in a direction conforming generally to the contour of the inner wall and the adjacently superposed layer 16. The thermal liner extends over an area which is coextensive with the major portion of the area of the inner wall of shell 12.

The matrix 22 of the thermal liner is formed with a plurality of pockets 24, each of which is discretely isolated from the remaining pockets. Each pocket contains a quantity of a heat exchange medium such as a coolant. In accordance with the preferred embodiment of the invention the coolant is a fusable liquid, desirably water, which is pre-frozen before the liner is positioned within the shell for use, providing the liner with a plurality of interconnected frozen cubes. It will thus be appreciated that after placement of the helmet on the wearer's head and for a prolonged period of time, during which period of time the frozen coolant is melting, heat will be absorbed from the head of the individual and from the area within the helmet in proximity to the head so as to increase the comfort and physical safety of the individual.

The matrix is to some extent stretchable as well as flexible so as to allow conformation of the liner to the head of the wearer and to accomodate a range of head sizes. The matrix may consist of a webbing structured to maintain therein a plurality of individual sealed receptacles each containing the heat exchange medium, or group of receptacles which may be interconnected and communicate with each other but are sealed about their periphery. Alternatively, and as depicted in part in FIG. 1, the matrix may include a pair of superposed sheets 26, 28 joined to each other along a pattern of regions 30 which define the pockets therebetween and are sealed about their external peripheral edges. The sheets may be joinable relasably by forming the regions on one of such sheets with a linearly extending protuberance cooperable with a linearly extending recess in the corresponding joinable region of the other sheet. Thus, the sheets may be separated for filling of the pockets with the heat exchange medium and thence snapped into joined sealed engagement for containment of the heat exchange medium within the pockets. As can be seen most clearly from FIG. 1 the regions of the matrix between the pockets constitutes an edge which is deformable so as to enable the liner to take the shape illustrated. The matrix is fabricated so as to desirably provide pockets approximately one-fourth inch in depth. This will afford adequate space between the liner 20 and the shell for the layer of impact absorbing material 16.

The matrix may be fabricated from a variety of materials, including conventional textile materials, where the receptacles for the heat exchange medium are separate and distinct elements, and synthetic plastics materials where so desired. Preferred materials are polyethylene, polypropylene and polyvinylchloride.

The thermal liner with its frozen cubes 32 may be removably positioned within the shell of the helmet by conventional fastening means such as snap fasteners or Velcro strips. Inasmuch as the selection of and the specific location of such fastening means may be readily determined as desired, the details of construction in this regard are not deemed necessary for an understanding of the invention and are neither shown nor described.

A layer of a flexible material 34 is preferably disposed inwardly of the impact absorbing material and the thermal liner so as to cover the liner. Such layer 34 may constitute one surface of the matrix or it may be secured along one or more of its edges to the shell of the helmet and be foldable to permit insertion of the thermal liner before being resecured to the shell.

It is estimated that the thermal liner of the invention, when filled with a frozen coolant such as ice, will add approximately one pound to the weight of the helmet. Such a thermal liner can be expected to remain cold for a period of time ranging from one-half to one hour in a warm environment during which time the individual is engaging in fairly vigorous physical activity. It will, of course, be recognized that an advantage of the invention is that when the thermal liner is no longer effective it can be removed from the helmet and replaced with a fresh frozen liner if so desired.

The invention also provides a container having a construction which facilitates the freezing of the heat exchange medium of the liner 20 and also enables storage of a plurality of frozen liners under conditions favorable for the maintenance of the heat exchange medium in its frozen state for substantial periods of time. The container may be dimensioned so as to be positionable within a freezer unit operating under standard conventional conditions. A school kitchen refrigerator can be used, for example, to be convenient for use by a school athletic team. The preferred construction is shown in FIG. 3.

The container 35 comprises an elongated shell 36 the walls of which are perforated with a plurality of apertures 38 so as to maximize the flow of cold air from the freezer chest (not shown) within which the container is positioned through the container to effect freezing of the cooling medium in the thermal liners 20 stacked therein.

A base element 40 formed of a suitable heat insulating material is secured across one end of the container to close same. The base element desirably projects outwardly of the shell to thereby present a shoulder 42 for the support of a side wall cover member 44 to be described.

Figure 3:
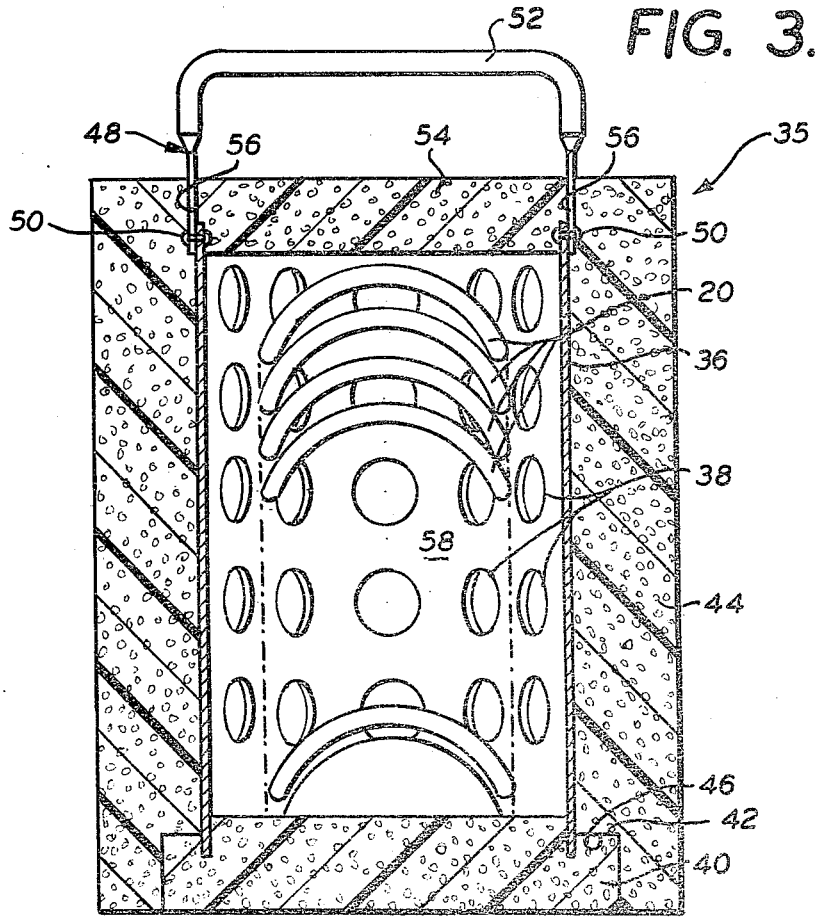
FIG. 3 is an elevational cross-sectional view of a container, taken along the vertical center line thereof, embodying the features of the invention.

A side wall cover member 44 also formed of a heat insulating material is configured and dimensioned to be removably positioned about the shell of the container and, as shown in FIG. 3, desirably one peripheral end of such cover member is undercut so as to provide a seating surface 46 complementary to shoulder 42 of the base element. The side wall cover member is thus supportable on the base element. The side wall cover member may be constructed in one or more peripherally extending sections; however, when constructed in more than one section the member should present a continuous surface to the ambient atmosphere in order to provide optimum insulation for the shell.

A handle element 48 is secured to the end of the shell remote from that to which base element 40 is secured. Preferably the handle element is pivotably connected to the shell such as by means of a double headed rivet 50. A hand grip element 52 may be provided formed of hard rubber or of another material with similar heat insulation characteristics.

A top cover member 54 formed of a heat insulating material is provided configured and dimensioned to be removably positioned upon and to thereby close the end of the shell remote from the base element. The top cover member and the side wall cover member are given cooperable abutting surfaces which provide an aperture 56 therebetween of adequate dimension to permit the extension therethrough of the handle element when the top cover is positioned atop the shell. When the top cover member and the side wall cover member are in place it will be seen that the shell is completely insulated from the ambient atmosphere.

The shell may be given any desired configuration; however, since the thermal liners 20 are employed in arcuate form it is desirable that shell 36 be cylindrical to facilitate stacking of the liners therein.

As stated earlier, in use the thermal liners are filled with a heat exchange medium such as water and are stacked within the shell of the container with top cover member 54 and side wall cover member 44 removed therefrom. The container is positioned within a freezer unit and kept therein until the heat exchange medium in pockets 24 is frozen. When the liners are to be used the container may be removed from the freezer, the top cover member and side wall cover member are mounted on the container thereby insulating the chamber 58 from the ambient atmosphere. The container may then be transported to the location where the thermal liners are to be utilized, such as at the site of a football field, and the liners may be removed as needed. It is estimated that the liners could be thus stored within the container for several hours without excessive melting of the frozen heat exchange medium, such as ice.

Various modifications and changes have been suggested in the foregoing description. Others will be obvious to those skilled in this art. Consequently, it is intended that the present disclosure be illustrative only and not limiting of the scope of the invention.

What is claimed is:

1. A protective helmet comprising:

a shell including an inner wall which is contoured for mounting on the head of a person in protective relation thereto;

an impact absorbing material positioned within said shell in face-to-face abutting relation with said inner wall throughout at least a substantial portion of the surface thereof; and having an inner surface conforming to the head of the wearer a shaped matrix having a plurality of individual pockets, each of which contains a heat exchange medium said matrix being located within a correspondingly formed recess in said impact absorbing material, and extending over an area coextensive with the major portion of the area of said surface of said impact absorbing material, said matrix being flexible to assume a shape conforming to that of said impact material, and means for removably securing said matrix to said impact absorbing material.

2. The protective helmet according to claim 1, wherein said matrix includes a pair of superposed sheets joined to each other along a pattern of regions which define said pockets therebetween.

3. The protective helmet according to claim 2, wherein said sheets are joinable releasably.

4. The protective helmet according to claim 2, wherein said matrix is deformable along said regions between the pockets.

5. The protective helmet according to claim 1, wherein said matrix is fabricated of a synthetic plastics material.

6. The protective helmet according to claim 5, wherein said synthetic plastics material is selected from polyethylene, polypropylene and polyvinylchloride.

7. The protective helmet according to claim 1, wherein said pockets contain ice.

* * * * *